US011465435B2

(12) United States Patent
Junglas et al.

(10) Patent No.: US 11,465,435 B2
(45) Date of Patent: Oct. 11, 2022

(54) COUPLING DEVICE

(71) Applicant: ACCO Brands Corporation, Lake Zurich, IL (US)

(72) Inventors: Hannah E. Junglas, Novelty, OH (US); Edward P. Busam, Mason, OH (US)

(73) Assignee: ACCO Brands Corporation, Lake Zurich, IL (US)

( * ) Notice: Subject to any disclaimer, the term of this patent is extended or adjusted under 35 U.S.C. 154(b) by 15 days.

(21) Appl. No.: 17/094,256

(22) Filed: Nov. 10, 2020

(65) Prior Publication Data

US 2022/0144007 A1 May 12, 2022

(51) Int. Cl.
*B42F 3/04* (2006.01)
*B42F 3/00* (2006.01)

(52) U.S. Cl.
CPC ..... *B42F 3/04* (2013.01); *B42F 3/003* (2013.01)

(58) Field of Classification Search
CPC ..... B42F 3/04; B42F 3/003; B42F 3/00
USPC ..... 40/299.01, 341, 358, 359, 360, 642.02; 281/3.1, 5, 7, 9, 10, 12, 15.1, 45; 283/36, 283/37, 38, 39, 40, 41, 61, 62, 63.1, 81
See application file for complete search history.

(56) References Cited

U.S. PATENT DOCUMENTS

| | | | | |
|---|---|---|---|---|
| 5,419,018 | A | 5/1995 | Karlis et al. | |
| 5,915,873 | A | 6/1999 | Karlis | |
| 6,672,785 | B1 * | 1/2004 | O'Hara | B42B 5/12 402/57 |
| 6,776,550 | B2 | 8/2004 | Roca | |
| D568,930 | S | 5/2008 | Declerck | |
| 10,076,924 | B2 | 9/2018 | Jameson et al. | |
| 2005/0036824 | A1 | 2/2005 | Moss | |
| 2005/0117963 | A1 * | 6/2005 | Metcalf Hall | B42F 13/02 402/60 |
| 2006/0285914 | A1 | 12/2006 | Bassford et al. | |
| 2009/0311037 | A1 | 12/2009 | Leung | |
| 2010/0150641 | A1 | 6/2010 | Wilpart et al. | |
| 2018/0043721 | A1 | 2/2018 | Bartlett et al. | |

FOREIGN PATENT DOCUMENTS

| | | |
|---|---|---|
| FR | 2383024 | 10/1978 |
| FR | 2805209 | 8/2001 |

OTHER PUBLICATIONS

Photos of product publicly available prior to Nov. 10, 2020.

* cited by examiner

*Primary Examiner* — Justin V Lewis
(74) *Attorney, Agent, or Firm* — Fitch, Even, Tabin & Flannery LLP

(57) ABSTRACT

A device for removably coupling one or more sheets of stationery to a notebook or similar item is provided and a portion of the coupling device, such as one or more arms, may extend through one or more holes in the stationery to retain the stationery to the notebook. Providing a device for removably attaching stationery items to a notebook allows students, planners, professionals, and other users to securely retain items in a notebook at a specific location within the pages thereof. In operation, such a coupling device permits users to keep track of a variety of items in a bound component.

26 Claims, 13 Drawing Sheets

COUPLING DEVICE

FIELD

The present disclosure relates to coupling devices and, in particular, to coupling a stationery item to a bound component such as a notebook.

BACKGROUND

Ring-, wire-, or coil-bound notebooks, planners, diaries, journals, logbooks, and the like are used for recording and tracking information, drawing, planning, and brainstorming, among other uses. For example, such devices typically include a plurality of bound pages that are at least partially blank. Though such items are useful for recording information, these bound notebooks are not particularly well-suited to storing or retaining loose-leaf papers, computer printouts, handouts, and other documents.

For example, many students use notebooks, such as spiral bound notebooks, for taking notes during class or lectures. Occasionally, an instructor may provide a handout that a student wants to keep in addition to their notes. While the student may store the handout in a separate location, such as a folder, this typically requires they remember to retrieve the handout when reviewing their notes at a later time and also where the handout is located at that later time. This is inconvenient and the student risks losing the handout if they do not recall where it was stored. To avoid this problem, some students may simply place the handout in the notebook near the pages of the notes that the handout is associated with (e.g., notes from the same lecture). This is problematic, however, as the handout is prone to falling out of the notebook and becoming disassociated with the lecture notes. Another option for the student is for them to permanently attach the handout to the notebook, such as, via a staple, tape, or glue, but this limits the future use of the handout since the handout cannot be easily removed and reinserted or moved to a different location within the bound component and is also relatively time consuming and inconvenient.

Similar issues may be encountered by those who regularly use activity planners, such as monthly or daily planners or calendars. For example, an individual who has planned a family dinner at a restaurant may want to remember to bring along an envelope of coupons or gift certificates to the restaurant. While keeping the envelope in another location may increase the likelihood that the individual will forget to bring the envelope, it also may take considerable time and energy to staple or glue the envelope into position on the relevant pages of the planner. In addition, this requires space on the page to avoid an envelope obscuring other information on the calendar page. Accordingly, additional tools to help individuals organize items including, for example, papers, certificates, documents, receipts, notes, handouts, cards, loose-leaf papers, computer printouts, and other stationery items would be of interest to a variety of individuals.

DETAILED DESCRIPTION

Figures 1A, 1B, 1C:
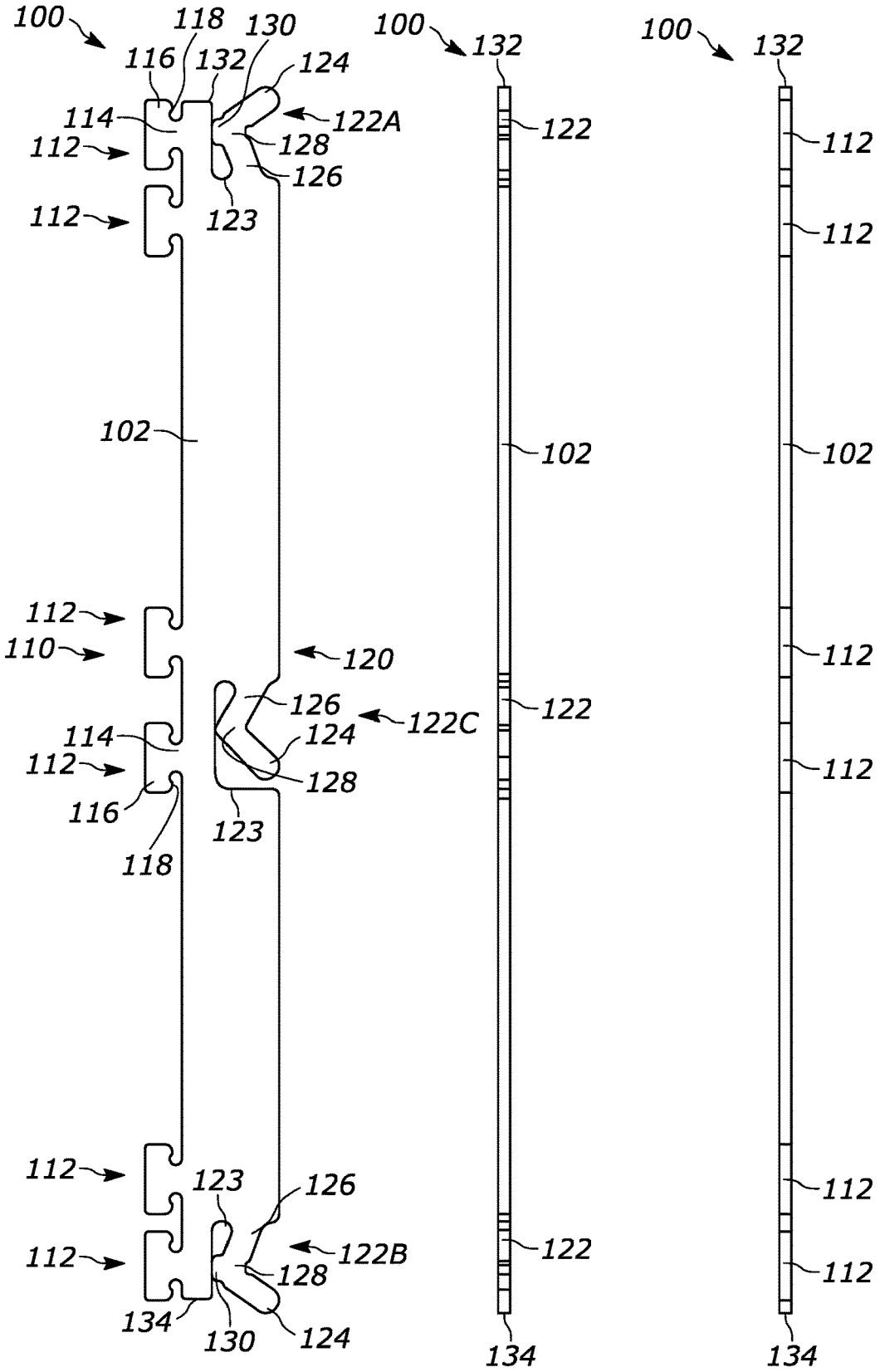
FIG. 1A is a top plan view of a coupling device according to a first embodiment, the bottom plan view being a mirror image thereof.
FIG. 1B is a front elevational view of the coupling device of FIG. 1A.
FIG. 1C is a rear elevational view of the coupling device of FIG. 1A.
Figure 1D:
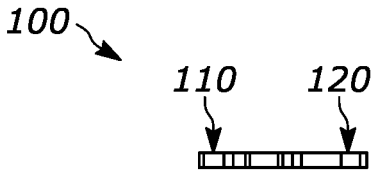
FIG. 1D is a left side elevational view of the coupling device of FIG. 1A, the right side elevational view being a mirror image thereof.

Generally speaking, described herein are systems, apparatuses, and methods to provide for coupling stationery to a notebook or similar item. The coupling devices described herein may be used to removably attach a stationery items (e.g., a handout, papers, certificates, documents, receipts, notes, cards, loose-leaf papers, computer printouts, among others) having one or more holes therethrough to another component, such as, for example, those with a ring, wire, or coil binding including those found on notebooks. Providing a device for removably attaching stationery items to a notebook allows students, planners, and other users to securely retain items in a notebook at a specific location within the pages of the notebook. As one example, using one of the coupling devices disclosed herein, a student can attach a handout of single or multiple sheets from a lecture to the notebook near the pages of the notebook where the student took notes for that lecture. Thus, when the student reviews their notes, the handout associated with their notes is securely stored in proximity to the related notes. The student also may easily remove the handout from the notebook for review and then reattach the handout to the coupling device within the notebook for storage. Given the time and space demands of many people, such organizational tools are useful to students, professionals and others that must keep track of a variety of informational and other paper items.

As another example, a user may make notes on loose-leaf paper that they desire to store in the notebook and associate with specific pages of the notebook. This may occur, for example, when a student takes notes on loose-leaf paper instead of in a notebook they forgot to take to class. To securely store the loose-leaf paper notes within the notebook, the user may use a coupling device described herein. The user may attach the first side of the coupling device to the notebook in between any two pages of the notebook. The user also may attach the loose-leaf paper notes to the second side of the coupling device via one or more holes therein, thus securing the loose-leaf paper notes to a specific location within the notebook for storage. As another example, a user may desire to secure loose-leaf paper to a notebook as described above when the user has used all of the pages of the notebook. Where the notebook is a one subject notebook, additional sheets of paper may be attached at the end of the notebook. Where the notebook is a multiple subject notebook, paper may be attached at the end of the subject section of the notebook that no longer has unused pages.

Once attached to a coil binding, the coupling devices may be detached from the coil binding and later reattached to another coil binding. The coupling devices are thus reusable.

In one illustrative configuration, a coupling device includes a thin, flat sheet with an elongate body having a first coupling mechanism or extension along a first side thereof and a second coupling mechanism or extension along a second side opposite thereof. By one approach, the first coupling mechanism includes a plurality of projections configured to attach to a binding including an array of coils and the second coupling mechanism includes at least first and second retention arms attached at the second side of the body. In some configurations, the retention arm(s) are inserted through hole(s) formed in the stationery to attach the stationery to the elongate body. To secure the stationery to the coupling device, in some embodiments, the first retention arm extends generally toward a first end of the elongate body and the second retention arm extends generally toward a second end of the elongate body, disposed opposite of the first end. In other embodiments, the first retention arm and the second retention arm extend generally toward the first end of the elongate body. The coupling device may include a third retention arm disposed between the first retention arm and second retention arm that extends generally perpendicular to or in the opposite direction of the first retention arm and the second retention arm to secure the stationary thereto. In some forms, the third retention arm has a configuration that is different than the first retention arm and the second retention arm. In addition, some embodiments may include more than two coupling mechanisms, extensions or retention arms.

As used herein, the thin, flat material forming the coupling device elongate body is typically formed of a unitary piece of semi-rigid material, that may be elastic such that when the elongate body or portion thereof is flexed from an original position (such as to thread the retaining arms through openings in paper) the elongate body or portion thereof elastically returns to the original position once the force flexing the material is no longer applied thereto.

To assist with retention of the stationery relative to the coupling mechanism, in some configurations, the retention arms may have multiple sections with differently angled or directed portions. In one illustrative example, the first and/or second retention arm includes a retaining portion and a guide portion, where the retaining portion is attached to the elongate body and extends at least in part toward the first side of the elongate body and the guide portion attaches to the retaining portion and extends away from the retaining portion. By one approach, the first and section portions of the retention arm have an elbow disposed therebetween (which may be disposed adjacent a remainder of the coupling device) to assist with retaining the stationery to the coupling device. In one illustrative example, the elbow includes a protrusion, which may have a width and/or length wider than the surrounding portions of the retaining arm. Further, in some configurations, the coupling device includes a notch into which a portion of the retaining arm nests, such as an elbow thereof.

In another embodiment, a plurality of coupling mechanisms or devices are formed in a semi-rigid sheet of flexible material. By one approach, the semi-rigid sheet of flexible material includes a plurality of die-cuts forming a plurality of partially die-cut handout coupling mechanisms. In one embodiment, each of the plurality of partially die-cut handout coupling mechanisms include an elongate body having a first coupling mechanism attachable to an array of coils and a second coupling mechanism, oppositely disposed from the first coupling mechanism, for securing stationery thereto. In some configurations, the second coupling mechanism includes one or more retention arms. For example, the second coupling mechanism may include a first retention arm and a second retention arm attached at the second side of the elongate body for insertion through holes formed in stationery to attach the stationery to the coupling mechanism and the array of coils. In one illustrative embodiment, the first arm extends at least in part in a first longitudinal direction and the second arm extends at least in part in a second longitudinal direction opposite the first longitudinal direction.

In some configurations, one or more coupling devices may be provided to the user along with the notebook or other bound component. By one approach, a semi-rigid sheet of flexible material with multiple coupling mechanisms partially die cut therein may be secured to the bound component, such as, via an overwrap and/or an array of holes in the semi-rigid sheet through which a coil binding extends. In yet another approach, individual coupling mechanisms may be provided with the notebook such as, for example, by having a first coupling mechanism of the device being coupled with the notebook.

Figure 1E:
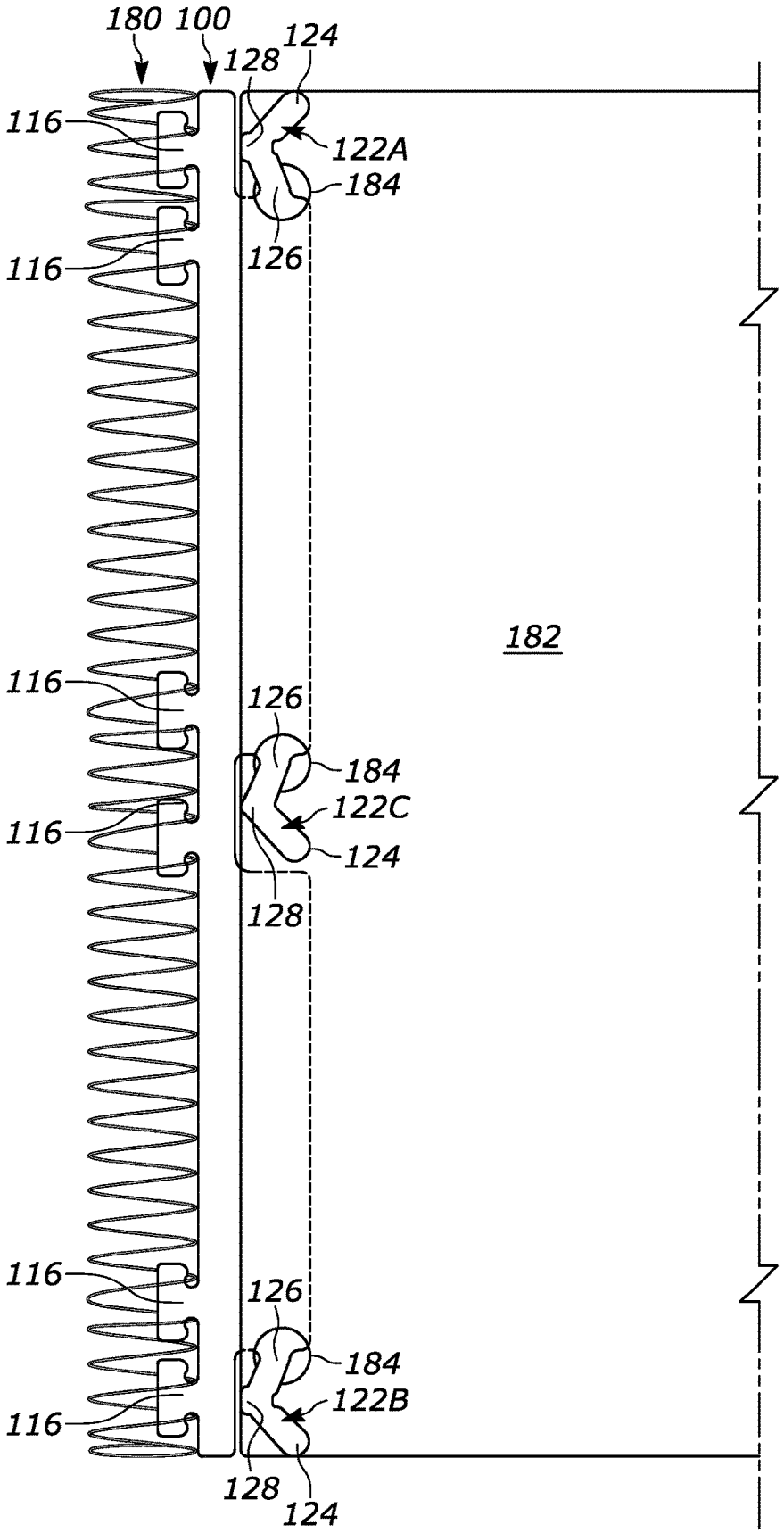
FIG. 1E is a top plan view of the coupling device of FIG. 1A attached to a coil binding and stationery.

Referring now to the drawings, and more particularly FIG. 1A, a coupling device 100 is shown having an elongate body 102 with a first coupling mechanism 110 disposed along a first side of the elongate body 102 and a second coupling mechanism 120 disposed along a second side of the elongate body 102. FIGS. 1B-1E illustrate additional views of the coupling device 100. As shown in FIG. 1E, the first coupling mechanism 110 attaches to a binding formed of an array of coils 180 and the second coupling mechanism 120 attaches to stationery 182 via holes 184 therethrough.

In one illustrative embodiment, the elongate body 102, first coupling mechanism 110, and second coupling mechanism 120 are formed of a unitary piece of semi-rigid elastic material such as, for example, polypropylene, polyethylene, cardboard, paperboard, or a combination thereof. In embodiments where the coupling device 100 is formed from a paper-based material, the coupling device 100 may include a waterproofing coating or a lamination thereon. As shown and described below with regard to FIG. 17A-17B, the coupling device 100 may be formed by one or more diecuts in a sheet of the semi-rigid elastic material having the desired thickness. Being formed of such a semi-rigid elastic material allows the elongate body 102 or any portion thereof to be flexed from an original, resting position, into a second, flexed position. Further, when force is no longer applied to the elongate body 102, the elongate body 102 or the portion thereof elastically returns to the original position. In other words, when the elongate body 102 is bent or flexed from the original position from an outside force, it does not stay in the bent or flexed position but substantially returns to its original shape once the outside force is removed therefrom.

By one approach, the first coupling mechanism 110 includes a plurality of T-shaped attachment projections 112 extending from the first side of the elongate body 102. While the embodiment of FIG. 1A shows six attachment projections 112, in other embodiments, other numbers of attachment projections 112 may be used. As one example, the first coupling mechanism 110 includes only two attachment projections 112 at either end of the coupling device 100. In another example, the first coupling mechanism 110 includes a plurality of attachment projections 112 along the entire length of the elongate body 102.

In one exemplary embodiment, each attachment projection 112 has a neck 114 that extends away from the first side of the elongate body 102 that is connected to a head 116 disposed on the end of the neck 114 opposite the elongate body 102. The head 116 has a longitudinal length that is greater than the longitudinal length of at least a portion of the neck 114. As illustrated in FIG. 1A, the head 116 and neck 114 of the illustrative attachment projection 112 thus define recesses 118 for receiving coils of a binding or portions thereof. With reference to FIG. 1E, in attaching the coupling device 100 to a binding, the head 116 is passed into an interior portion of the array of coils 180 and at least partially through the space between two adjacent coils of the binding. To pass the head 116 between two adjacent coils, the head 116 may be flexed or bent to fit between the gap in the coils. In some configurations, when the elongate body 102 is attached to the coils of the binding (e.g., of a notebook), the head 116 extends behind the two adjacent coils i.e., into the interior portion of the array of coils 180 of the binding such that a portion of the coils are positioned in between a portion of the head 116 and the elongate body 102. Since the coils are generally disposed between the head 116 and the elongate body 102 during coupling, when the coupling device 100 is moved away from the binding, the head 116 hooks the two adjacent coils preventing the elongate body 102 from moving substantially in a lateral direction relative to the array of coils. The attachment projections 112 thus prevent the coupling device 100 from moving away from the coil of the binding, but allow the coupling device 100 to be slid around the coil, for example, when pages of the notebook are turned.

The recesses 118 may be sized and shaped to receive the coils of the binding and aid to prevent the coils from unintentionally exiting the recesses 118 without the application of additional force, for example, without flexing or twisting the attachment projection 112. As one example, the recesses 118 may be shaped such that the coils of the binding snap into the recesses 118. A portion of the head 116 may flex to allow the coil to pass into the recess and, once the coil is within the recess 118, the portion of the head 116 returns to its original position to thereby retain the coil within the recess 118.

As used herein, the array of coils forming the binding may be any coil, wire or disc binding types. By way of example, the array of coils may be a spiral wire binding, a twin wire binding, one of a variety disc binding systems including the Staples ARC system, Levenger Circa Disc system, GBC binding coils, GBC ProClick coils, and the like. While the example embodiment shown in FIG. 1E includes attachment projections 112 adapted to attach to a spiral or twin-wire binding, the head 116 and neck 114 of the attachment projections 112 may be adapted for use within any binding formed of an array of coils, such as those examples given above. The attachment projections 112 may be adjusted such the head 116 has a longitudinal length that is longer than the gap between two adjacent coils of a binding and the neck 114 has a longitudinal length that is smaller than the gap between the coils. In operation, the recesses 118 formed by the head 116 and neck 114 may be sized and shaped to receive and securely retain the coil of any type of coil.

To remove the first coupling mechanism 110 from the binding formed from an array of coils, the attachment projections 112 may be flexed or bent, such as by applying manual force to the elongate body 102, to remove the heads 116 of the attachment projections from being within the coil. The coils then are no longer disposed within the recess 118 formed by the head 116 and neck 114. By one approach, the attachment projections 112 are capable of removal from a coil binding at the same time. By yet another approach, the attachment projections 112 are designed to be removed from the coil binding individually or in sections, such as removing two of a total of six attachment projections at one time. Once all of the attachment projections have been removed from the coil of the binding, the coupling device 100 is typically no longer attached to the binding.

As illustrated in FIG. 1E, the second coupling mechanism 120 enables a stationery item 182 to be attached to the coupling device 100. As used herein, the term stationery refers to any item that may be attached to the rings or coils of a binder including, but not limited to, as examples paper sheets, pockets, dividers, notecards, envelopes, documents, cards, certificates, receipts, among others. In some configurations, several pages, plies, or sheets of paper may be secured via the second coupling mechanism. When the first coupling mechanism 110 is attached to the binding of a notebook and the stationery item(s) are attached to the second coupling mechanism 120 of the coupling device 100, the stationery item(s) are removably coupled to the notebook.

In one illustrative configuration, the second coupling mechanism 120 includes three retention arms 122 extending from the elongate body 102. In the embodiment of FIG. 1A, the retention arms 122 are disposed in a recessed region 123 on a side of the elongate body 102 opposite the attachment projections 112. By one approach, at least a portion of the retention arms 122 are sized to be inserted through a hole formed in stationery to attach the stationery to the elongate body 102. As an example, the hole formed in the stationery may be the hole formed by a hole punch. In the embodiment shown in FIGS. 1A-1D, the retention arms 122 are spaced apart such that they may be inserted through the three holes of stationery having a three-hole punch spacing that is adapted to be attached to three ring binders as is well-known in the art. While the coupling device 100 shown in FIGS. 1A-1D includes three retention arms 122, stationery may be attached to the coupling device using only one or two of the retention arms 122. For example, a loose-leaf sheet of paper having 3-holes may be attached to the elongate body 102 of the coupling device 100 using the upper retention arm 122A and the lower retention arm 122B. In another example, a 5×7 notecard may be hole punched and attached to the elongate body 102 using only the upper retention arm 122A and the middle retention arm 122C, not being long enough to reach all three retention arms 122.

As shown in FIG. 1A, the retention arms 122 include a first portion or guide portion 124 and a second portion or retaining portion 126 that are connected to one another at an elbow 128. In use, the first, guide portion 124 may be easily flexed out of the plane of the elongate body 102 to thread the retaining arm(s) 122 through an opening or hole in a piece of stationery, and the elbow 128 prevents the stationery from unintentionally disengaging from the retaining arm(s) 124. In addition, the second, retaining portion 126 may be long enough to retain a plurality of items of stationery when the coupling device 100 is in use.

As illustrated in FIG. 1A, the retaining portion 126 of the retention arms 122 extend from an edge of the recessed portion 123 of the elongate body 102 slightly toward the first coupling mechanism 110 at an angle of between about 15° to about 60° from a lengthwise direction or longitudinal axis of the elongate body 102. In another configuration, the angle is between about 15° to about 25°. By one approach, the angle is approximately 21° from the longitudinal axis of the coupling device 100. The guide portion 124 is joined to the retaining portion 126 at the elbow 128 and extends away from the first coupling mechanism 110 at an angle of between about 15° to about 60° from a lengthwise direction or longitudinal axis of the elongate body 102. In some embodiments, the guide portion 124 extends about 50° to about 60°. In one illustrative approach, the guide portion 124 extends at an angle of approximately 55° from the longitudinal axis. In other embodiments, the retention arm 122 may be mirrored, with the retaining portion 126 extending at an approximately 21° angle relative to the longitudinal axis away from the first coupling mechanism 110, with the guide portion 124 connected to the retaining portion 126 and extending back toward the first coupling mechanism 110 to form an approximately 55° angle with the longitudinal axis of the coupling device 100. In one illustrative approach, the angle of the retaining portion 124 is smaller than the guide portion 126, whereas in another configuration, the angles are approximately equal to one another. In yet another configuration the angle of the retaining portion 124 is larger than the guide portion 126.

In use, a user flexes or deflects the retention arm 122 or a portion thereof (such as, e.g., the first, guide portion 124) and passes the guide portion 124 and the elbow 128 through a hole of a stationery item. The guide portion 124 may include a rounded tip to aid in threading the guide portion 124 of the retention arm 122 through the hole of stationery. In one illustrative embodiment, the elbow 128 of the upper retention arm 122A and the lower retention arm 122B includes an expanded portion that increases the size of the elbow 128. In one illustrative example, the expanded portion of the elbow 128 is a bulbous protrusion 130 that increases the size of the elbow 128. By one approach, the elbow 128, such as via the bulbous protrusion 130 or another configuration, also increases the length along which the elbow 128 extends along the edge of the elongate body 102. In operation, once the elbow 128 and the bulbous protrusion 130 (if present) of the retention arm 122 has passed through the hole, a portion of the retaining portion 126 of the retention arm 122 extends through the hole of the stationery. When the user releases the retention arm 122 from the flexed position, the elbow returns to its position adjacent the edge of the elongate body 102. In one illustrative example, the elbow 128 is disposed directly alongside a remainder of the elongate body 102 such that there is little or no space therebetween. In another exemplary configuration, a small space or gap is disposed between the elbow 128 and a reminder of the elongate body 102. Since the gap between the elongate body 102 and the elbow 128 is small if present at all, the hole of the stationery is inhibited from passing back over the elbow because the material of the stationery forming the hole is unable to pass between the elbow 128 and the edge of the elongate body 102.

As shown in FIG. 1A, the retention arms 122 are attached to the elongate body 102 at the end of the retaining portion 126 opposite the elbow 128. The upper retention arm 122A, disposed proximate one end of the elongate body 102, extends generally toward the adjacent, upper end 132 of the coupling device 100 and the lower arm 122B extends generally toward the adjacent, lower end 134 of the coupling device 100. In one illustrative configuration, the middle retention arm 122C also extends generally toward the lower end 134 of the coupling device 100, though in other configurations it may extend generally toward the opposite upper end 132. In another illustrative configuration, the upper arm 122A and the lower arm 122B extend generally toward the same end. In this configuration, the middle arm 122C may extend generally toward the opposite end or extend in a direction generally perpendicular to the upper arm 122A and lower arm 122B to aid to prevent stationery from becoming detached from the second coupling mechanism 120. In some configurations, having at least one of the retention arms 122 face generally in the opposite direction of the other retention arms 122, such as retention arm 122A of the embodiment of FIGS. 1A-1D, is advantageous in preventing the stationery from becoming inadvertently detached from the second coupling mechanism 120, since the stationery is unable to become detached merely by moving in a single direction. Furthermore, if all of the retention arms 122 are disposed in the same general direction, the retention arms 122 may have varying configurations, features, or design and/or the elongate body 102 may be formed of a stiffer material that is more difficult for the retention arms 122 to flex from the plane of the elongate body 102.

As shown in the illustrative example of FIG. 1E, a piece of stationery 182 having three-holes 184 is attached to the second coupling mechanism 120 with the three retention arms 122 extending through the holes 184 of the stationery. Each hole 184 of the stationery encircles the retaining portion 126 of the corresponding retention arm 122. If the stationery 182 moves downward relative to the coupling device 100, the upper hole 184 of the stationery will engage the upper retention arm 122A and/or the elongate body 102 to which the retention arm 122A is attached and inhibit the stationery 182 from moving further in the downward longitudinal direction. This prevents the middle or lower holes 184 of the stationery 182 from moving far enough longitudinally to pass back over the elbows 128 of the middle retention arm 122C and lower retention arm 122B. Likewise, if the stationery 182 is moved upward relative to the coupling device 100, the lower and middle hole 184 of the stationery engage the lower retention arm 122B and middle retention arm 122C and/or the elongate body 102 to which the retention arms 122B, 122C are attached, inhibiting the stationery 182 from moving far enough upward relative to the coupling device 100 for the upper hole of the stationery 182 to pass back over the elbow 128 of the upper retention arm 122A and become detached.

In some applications, a user may attach the stationery to the coupling device 100 using fewer than all of the retention arms. For example, a piece of stationery may engage the upper retention arm 122A and only one of the middle retention arm 122C or the lower retention arm 122B. As an example, a user may attach a handout to the coupling device 100 using only the upper retention arm 122A and lower retention arm 122B and choose to not extend the middle retention arm 122C through the corresponding hole of the handout. As another example, a user may attach a notecard to the coupling device 100 using only the upper retention arm 122A and the middle retention arm 122C since the notecard is not long enough to be attached to all three retention arms 122. Since the upper retention arm 122A extends from the elongate body 102 in a direction that is generally opposite the middle retention arm 122C and the lower retention arm 122B, the stationery will still be secured to the coupling device 100 as described above even where only two of the three retention arms 122 are used. The middle retention arm 122C may be used optionally to further stabilize the middle portion of the stationery from flexing away from the coupling device 100.

To remove the stationery 182 from the coupling device 100, the retention arms 122 may be flexed and/or bent to withdraw the retention arms 122 from the holes 184 of the stationery 182. Once each of the retention arms 122 have been withdrawn from the holes of the stationery, the stationery 182 is detached from the coupling device 100.

The remaining FIGS. 2-17B show various alternative embodiments of the coupling device, each of the various embodiments being similar in many respects to the coupling device 100 shown and discussed in regard to FIGS. 1A-1D. For instance, each of the embodiments include a first and second coupling mechanism that are somewhat similar to the first coupling mechanism 110 and second coupling mechanism 120 described in regard to the first embodiment of FIGS. 1A-1D, though the design, distribution, arrangement, number and/or shape of the coupling mechanisms may be differently configured. For example, the first coupling mechanisms described below are configured to removably attach the coupling devices to a coil binding or similar component. Further, while the illustrated arrangement and configuration of the second coupling mechanism in the following embodiments differs in some aspects from the second coupling mechanism 120 of the first embodiment of FIGS. 1A-1D, the retention arms are generally passed through a corresponding hole of stationery to couple the stationery to the coupling device similar to the process described previously in regard to the first embodiment. For conciseness and clarity, the following discussion will highlight the primary differences of the following embodiments as compared to the other embodiments. For simplicity, the reference numerals used with regard to the first embodiment will be used to indicate features of the coupling device of the subsequent embodiments, with the prefix of the reference numerals changed to correspond to the embodiment being discussed. For instance, features of coupling device 200 of the second embodiment that correspond to features of the coupling device 100 are shown with the prefix of the reference numeral changed from "1" to "2." For example, a feature shown as "102" with regard to the coupling device 100 will be shown as "202" with regard to the coupling device 200. Features of coupling device 300 of the third embodiment that correspond to features of the coupling device 100 are shown with the prefix of the reference numeral changed from "1" to "3" and so on.

Figure 2:
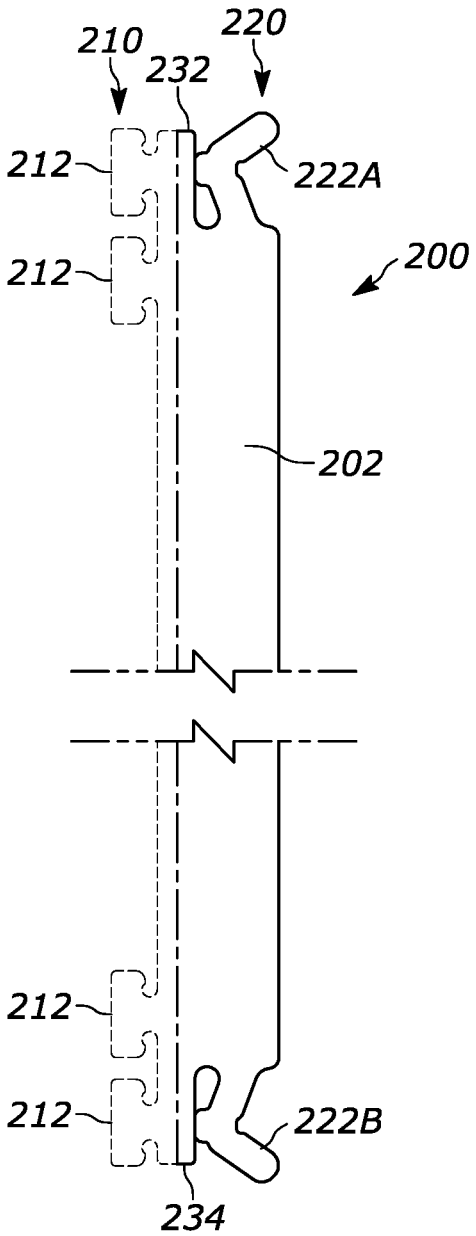
FIG. 2 is a top plan view of the coupling device of FIG. 1A according to a second embodiment.

With reference to FIG. 2, a coupling device 200 according to a second embodiment is shown similar to the coupling device 100 of FIGS. 1A-D. The coupling device 200 is shown with a symbolic break in its length.

Figure 3A:
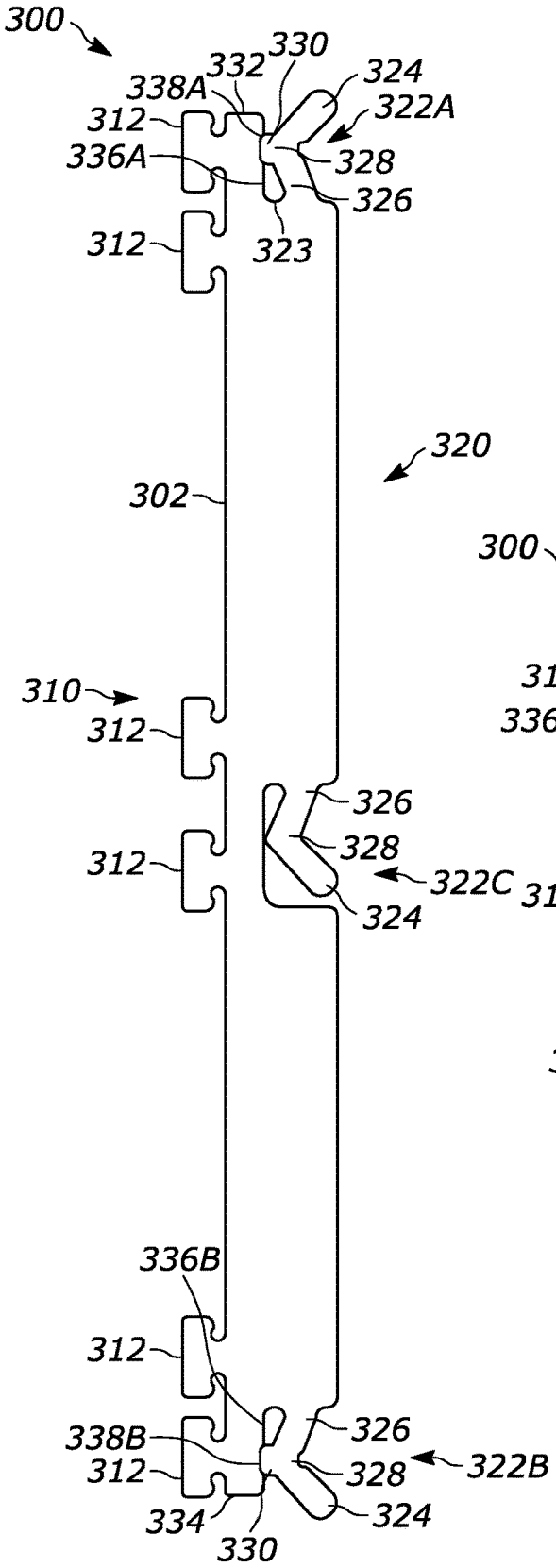
FIG. 3A is a top plan view of a coupling device according to a third embodiment.

With reference to FIG. 3A, a coupling device 300 according to a third embodiment is shown. The upper retention arm 322A and the lower retention arm 322B have an elbow 328 with a bulbous projection 330 that extends further toward the side of the coupling device 300 having the first coupling mechanism 310 than the bulbous projections 130 of the coupling device 100 of the first embodiment of FIGS. 1A-1D. The bulbous projection 330 of the upper retention arm 322A extends beyond an edge 336A of the elongate body 336 defining the recessed portion 323. The edge 336A of the elongate body 302 defines a notch 338A for receiving the bulbous projection 330 when the upper retention arm 322A is not flexed away from the plane of the elongate body 302. Likewise, the bulbous projection 330 of the lower retention arm 322B extends into a notch 338B along the edge 336B of elongate body 302 when the lower retention arm 322B is aligned with the elongate body 302.

This configuration of the third embodiment, with the bulbous projection 330 of the upper and lower retention arms 322A,B, extending further from the elbow 328, aids to prevent the holes of stationery from passing back over the elbows 328 of the upper and lower retention arms 322A,B, though it may require a bit more manual dexterity to thread the stationery onto the retention arms with a larger bulbous projection 330. The enlarged bulbous projection 330 aids to catch or hook a portion of the stationery forming the hole encircling the retention arm 322 which prevents the hole from passing over the elbow 328. When the bulbous projections 330 of the upper and lower retention arms 322A,B are received within the corresponding notches 338A,B of the elongate body 302 when the retention arms 322A,B are aligned with or not flexed away from the plane of the elongate body 302, there is no longer a gap or a straight path along which the hole of the stationery is able to travel to become inadvertently detached from the second coupling mechanism 320.

Figure 3B:
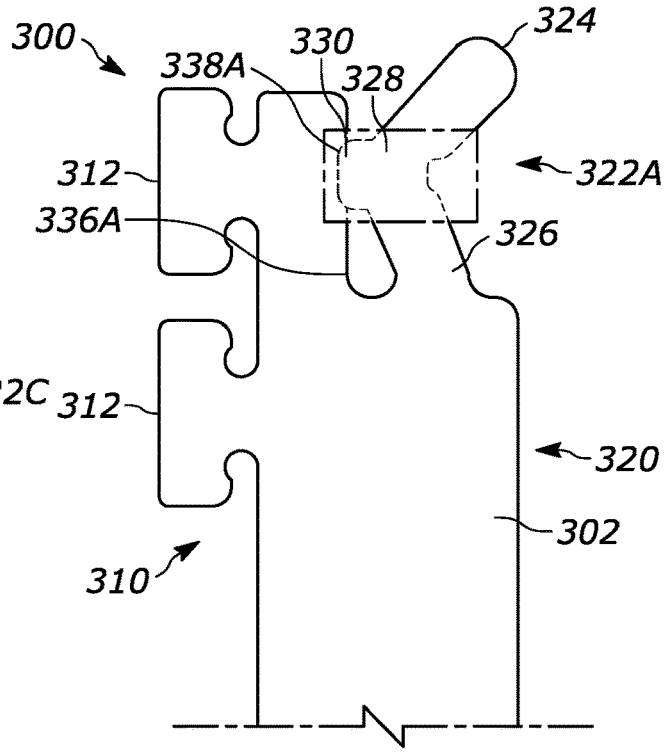
FIG. 3B is a top plan view of a portion of the coupling device of FIG. 3A.

FIG. 3B is a top plan view of a portion of the coupling device 300 of FIG. 3A. The coupling device 300 is shown with a symbolic break.

Figure 4:
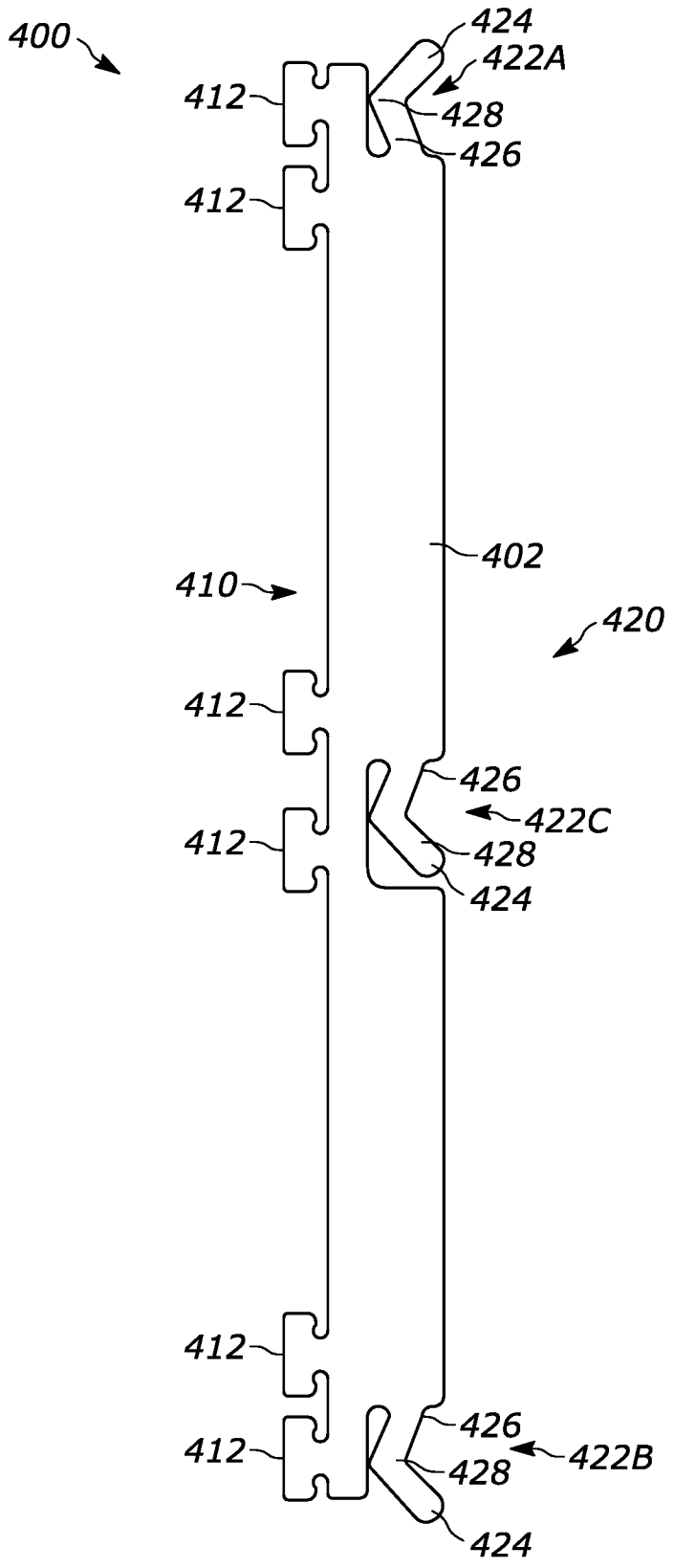
FIG. 4 is a top plan view of a coupling device according to a fourth embodiment.

With reference to FIG. 4, a coupling device 400 according to a fourth embodiment is shown. The difference between the coupling device 400 and the coupling device 100 is that the elbow 428 of the upper retention arm 422A and the elbow 428 of the lower retention arm 422B do not include a bulbous projection, such as the bulbous projection 130 of the coupling device 100. Rather, the elbows 428 of all of the retention arms 422 are the same, with the connection between the guide portion 424 and the retaining portion 426 forming the elbow 428 with no projection extending from the elbow 428. As shown in FIG. 4, the elbow 428 comes to a point which is adjacent the edge of the elongate body 402. In addition, the ends of the guide portion 424 may extend slightly beyond an end of a remainder of the elongate body 402. In this manner, the guide portion 424 may be easily grasped or angled upward from a remainder of the coupling device 400 to more easily thread the stationery onto the retention arms 422. Furthermore, while the embodiment of FIG. 4, illustrates the guide portion 424 having a slightly longer length, other configurations are possible, such that the guide portion 424 may be shorter to or equal the retaining portion 426.

Figure 5:
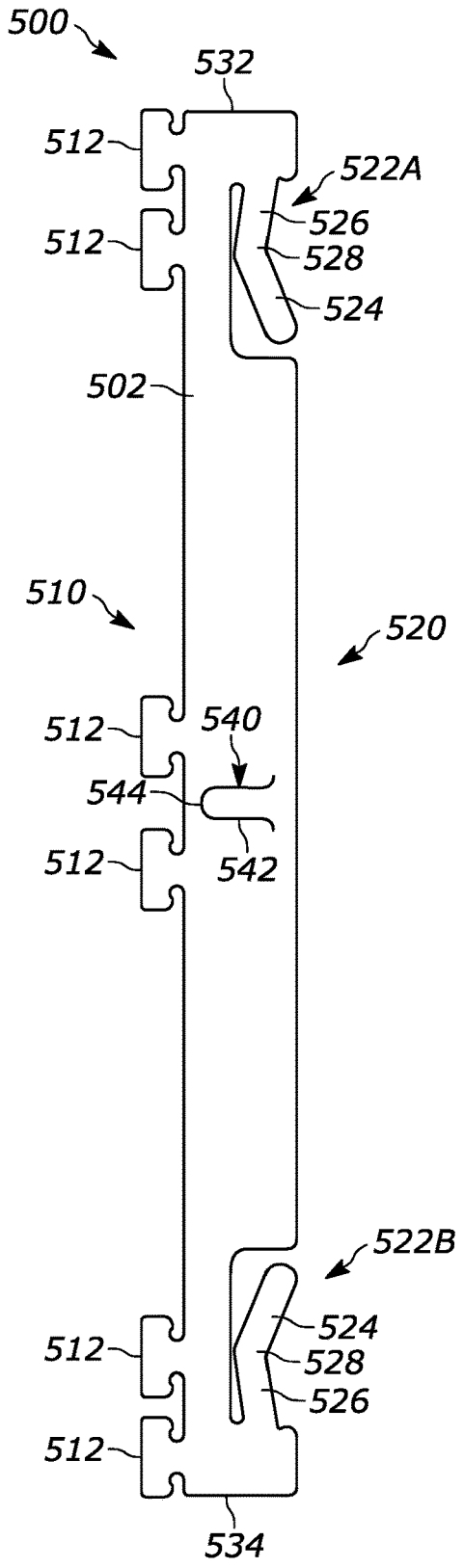
FIG. 5 is a top plan view of a coupling device according to a fifth embodiment.

With reference to FIG. 5, a coupling device 500 according to a fifth embodiment is shown. The second coupling mechanism 520 of the coupling device 500 is different than the previous embodiments, specifically in that the upper retention arm 522A generally extends inward, toward the lower, opposite end 534 of the coupling device 500, as illustrated. In addition, the lower retention arm 522B, which is positioned adjacent the other end of the coupling device 500, generally extends inward, toward the upper end 532.

While the upper retention arm 522A still extends in generally the opposite direction of the lower retention arm 522B, which as described above aids in retaining stationery coupled thereto, the retention arms 522A,B extend inward, toward a center of the elongate body 502, rather than outward. In the embodiment shown in FIG. 5 the retaining portions 526 extend from their attachment point to the elongate body 502 at an angle that is smaller than that illustrated in previous embodiments. For example, the angle may extend about 5° to about 50° from a lengthwise direction of a longitudinal axis. In some configurations, the angle may extend about 5° to about 12°. In one illustrative approach, the angle is approximately 8° relative to the longitudinal axis of the coupling device 500. Further, in some configurations, the guide portions 524 extend from the ends of the retaining portions 526 at approximately an angle of about 5° to about 50° from a lengthwise direction of a longitudinal axis. In some configurations, the angle may extend about 5° to about 12°. In one illustrative example, the angle is approximately 23° from the lengthwise axis. As shown in FIG. 5, The elbows 528 of the upper retention arm 522A and the lower retention arm 522B do not include a bulbous projection, however, in other embodiments the elbows 528 may be modified to include a bulbous projection to aid in retaining stationery.

As illustrated, the second coupling mechanism 520 of the coupling device 500 does not include a middle retention arm as in the previous embodiments, but rather includes a tongue 540 formed by a cut within the elongate body 502. The tongue 540 includes an elongate portion 542 that terminates at a tip 544. In use, the tip 544 and the elongate portion 542 of tongue 540 may be flexed away from the elongate body 502 such that the hole of stationery may be passed over the tip 544 of the tongue 540 to encircle the elongate portion 542 of the tongue 540. The tongue 540 may be used to aid in stabilizing a stationery item that is otherwise attached to the second coupling mechanism 520, aiding to prevent the middle portion of the stationery item from flexing away from the elongate body 502. In this manner, the tongue 540 may cooperate with the retaining arms 522 to prevent the stationery item from moving substantially longitudinally relative to the coupling device 500 and in a lateral direction away from the first coupling mechanism 510 of the coupling device 500.

Figure 6:
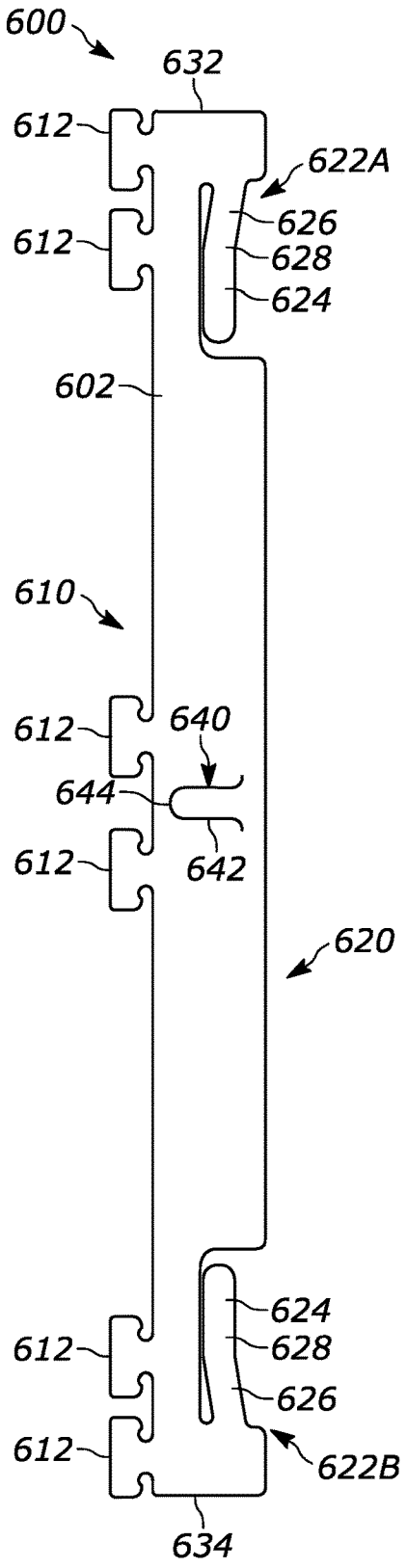
FIG. 6 is a top plan view of a coupling device according to a sixth embodiment.

With reference to FIG. 6, a coupling device 600 is shown according to a sixth embodiment. The coupling device 600 is similar in many respects to the coupling device 500 of FIG. 5, with the primary difference being the angle of the elbow 628 formed by the attachment of the retaining portion 626 to the guide portion 624 of the upper and lower retention arms 622A,B. As shown in FIG. 6, the retaining portions 626 of the upper and lower retention arms 622A,B extend from their attachment point to the elongate body 602 at approximately the same angle relative to the longitudinal axis as in the fifth embodiment of FIG. 5. The guide portions 624 of the upper and lower retention arms 622A,B extend from the retaining portion 626 at about 5° to about 25°, and in some configurations at an angle approximately 9° relative to the retaining portion 626 forming the elbows 628. The guide portions 624 thus extend approximately parallel to the longitudinal axis of the coupling device 600.

Figure 7:
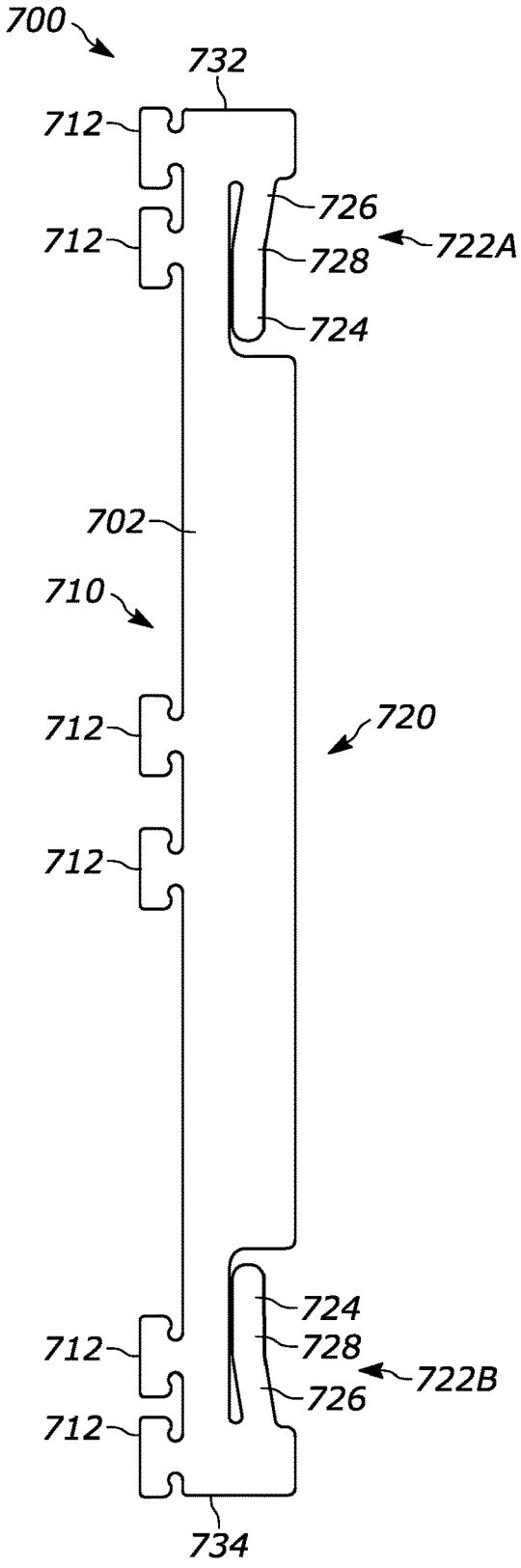
FIG. 7 is a top plan view of a coupling device according to a seventh embodiment.

With reference to FIG. 7, a coupling device 700 is shown according to a seventh embodiment. The coupling device 700 is similar in many respects to the coupling device 600 of FIG. 6, with the primary difference being that the coupling device 700 does not include a tongue or a middle retention arm at a point along the elongate body 702 between the upper retention arm 722A and the lower retention arm 722B.

Figure 8:
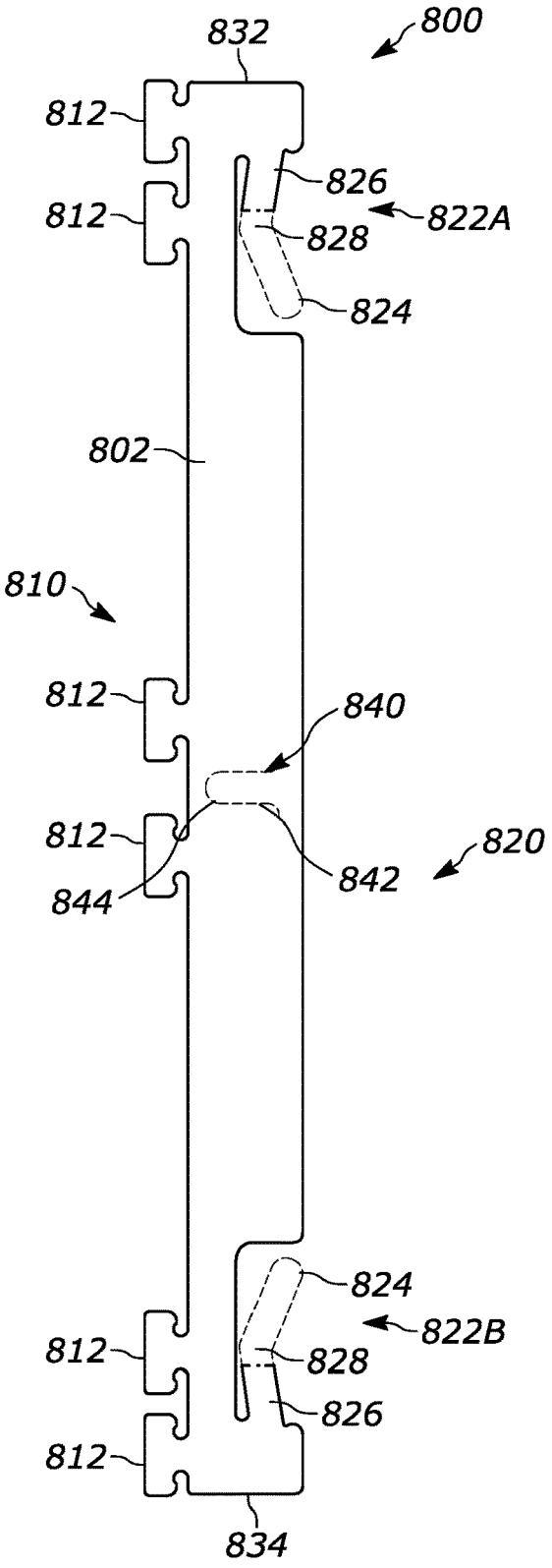
FIG. 8 is a top plan view of a coupling device according to an eighth embodiment.

With reference to FIG. 8 a coupling device 800 according to an eighth embodiment is shown.

Figure 9:
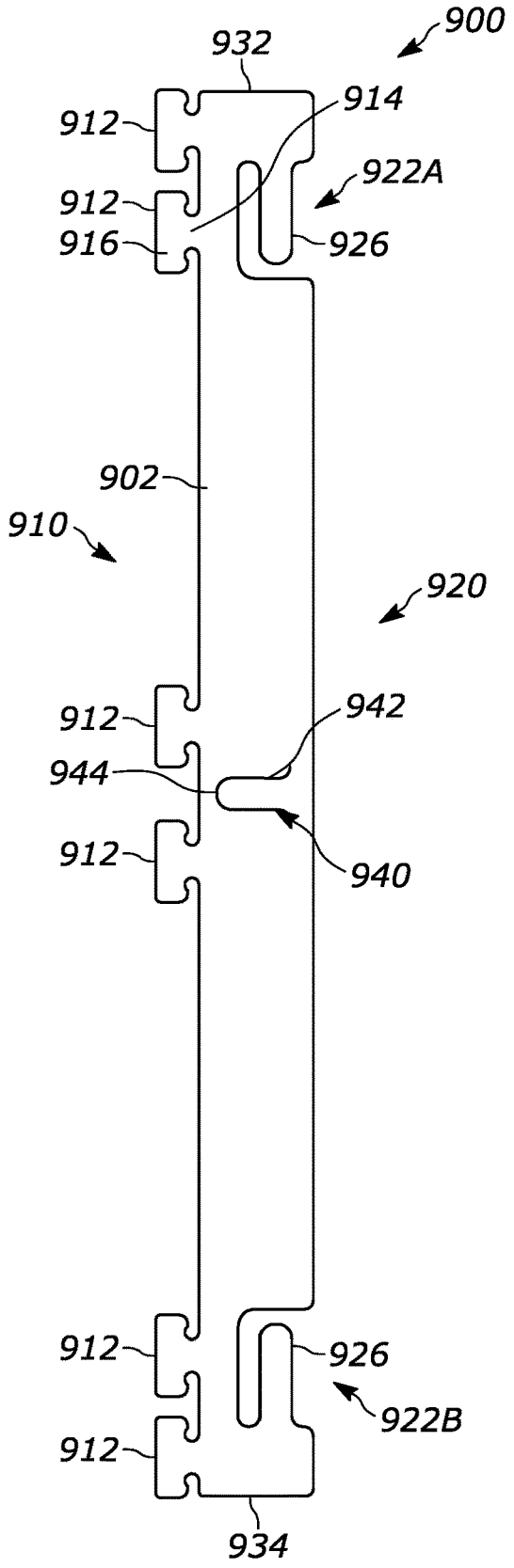
FIG. 9 is a top plan view of a coupling device according to a ninth embodiment.

With reference to FIG. 9, a coupling device 900 is shown according to a ninth embodiment. The coupling device 900 is similar in many respects to the coupling device 600 of FIG. 6, the primary difference being that the upper and lower retention arms 922A,B do not include an elbow. The upper and lower retention arms 922A,B only include a retaining or guide portion 926 that extends from the elongate body 902 substantially parallel to the longitudinal axis of the coupling device 900. In some configurations, the retention arms extend about 0.5 to 1.25 inch from their attachment points relative to the elongate body 902. As one example, the retention arms 922A,B extend approximately 0.7 inches from their attachment point to the elongate body 902. Using retention arms 922A,B that do not include an elbow or an angle therein makes attaching the stationery to the second coupling mechanism 920 easier as the retention arms 922A,B may more easily be passed through the holes of the stationery during attachment.

Figure 10:
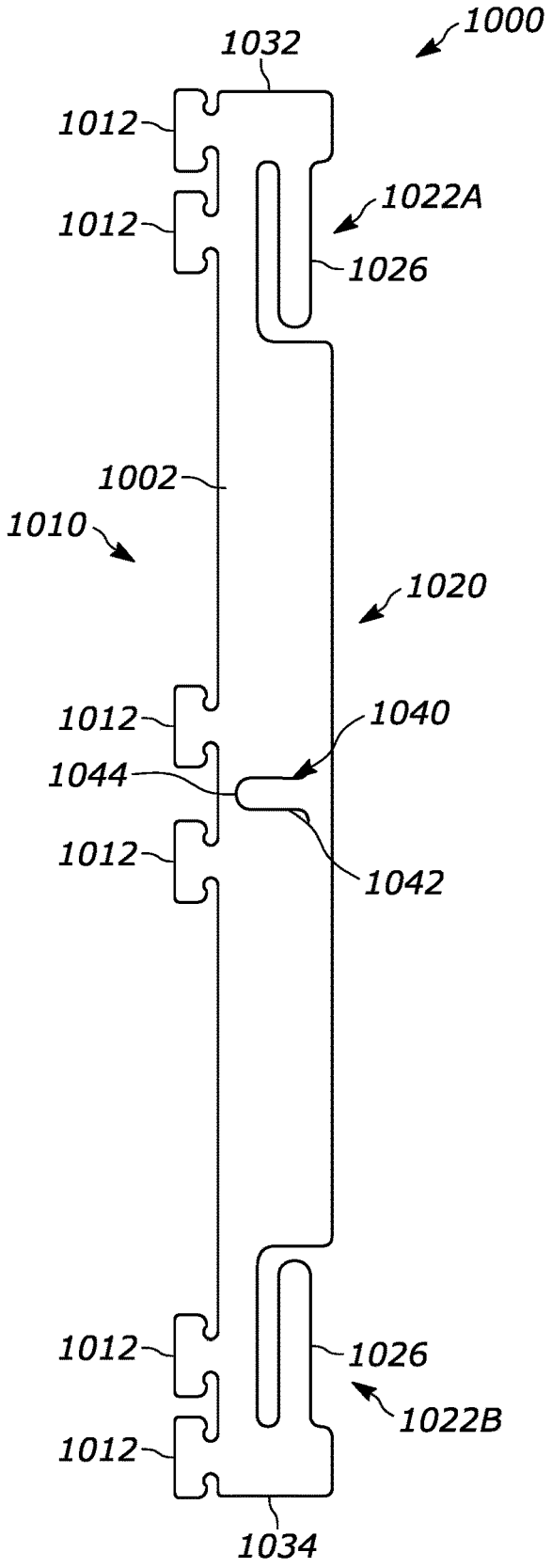
FIG. 10 is a top plan view of a coupling device according to a tenth embodiment.

With reference to FIG. 10, a coupling device 1000 is shown according to a tenth embodiment. The coupling device 1000 is similar in many respects to the coupling device 900 of FIG. 9, with the primary difference being the length of the upper and lower retention arms 1022A,B. As shown in FIG. 10, the retention arms 1022A,B extend approximately further from their attachment point to the elongate body 1002 than the retention arms 922A,B of the embodiment of FIG. 9. In the example where the retention arms 922A,B of the embodiment of FIG. 9 extend 0.7 inches, the retention arms 1022A,B extend 1.15 inches from their attachment point to the elongate body 1002. Using longer retention arms 1022A,B aids in preventing the stationery from sliding longitudinally relative to the coupling device 1000 and becoming inadvertently detached from the second coupling mechanism 1020.

Figure 11:
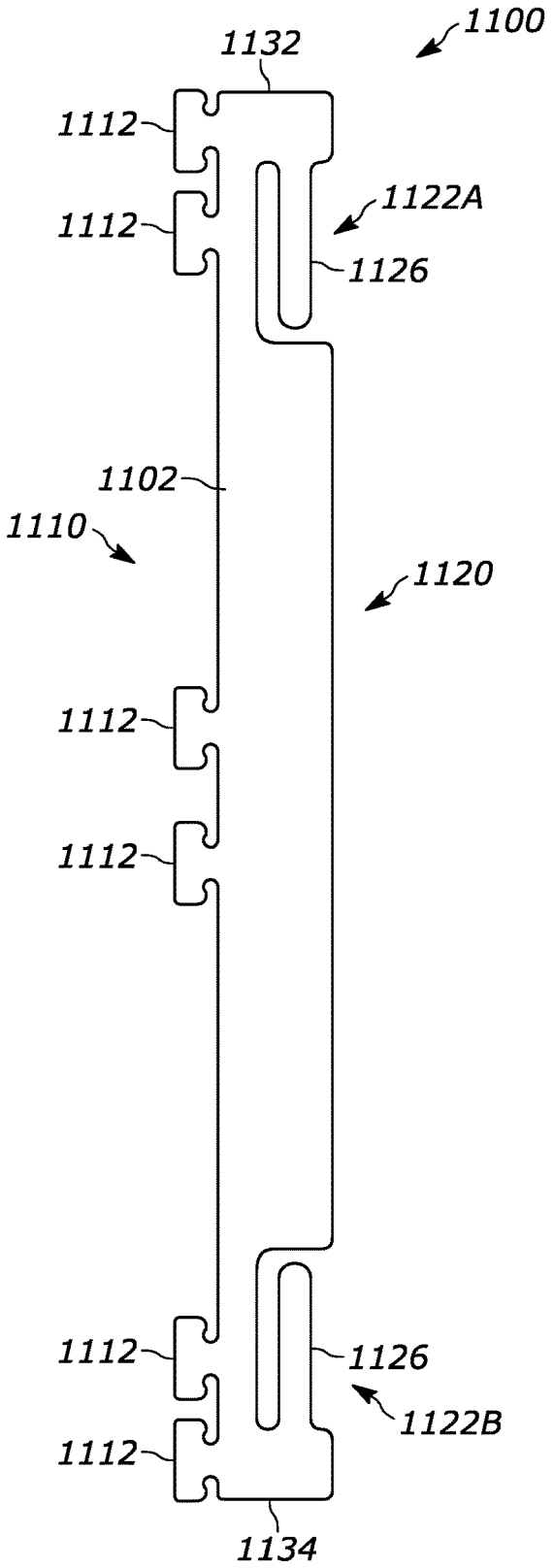
FIG. 11 is a top plan view of a coupling device according to an eleventh embodiment.

With reference to FIG. 11, a coupling device 1100 is shown according to an eleventh embodiment. The coupling device 1100 is similar in many respects to the coupling device 1000 of FIG. 10, with the primary difference being that the coupling device 1100 does not include a tongue or a middle retention arm at a point along the elongate body 1102 between the upper retention arm 1122A and the lower retention arm 1122B.

Figure 12:
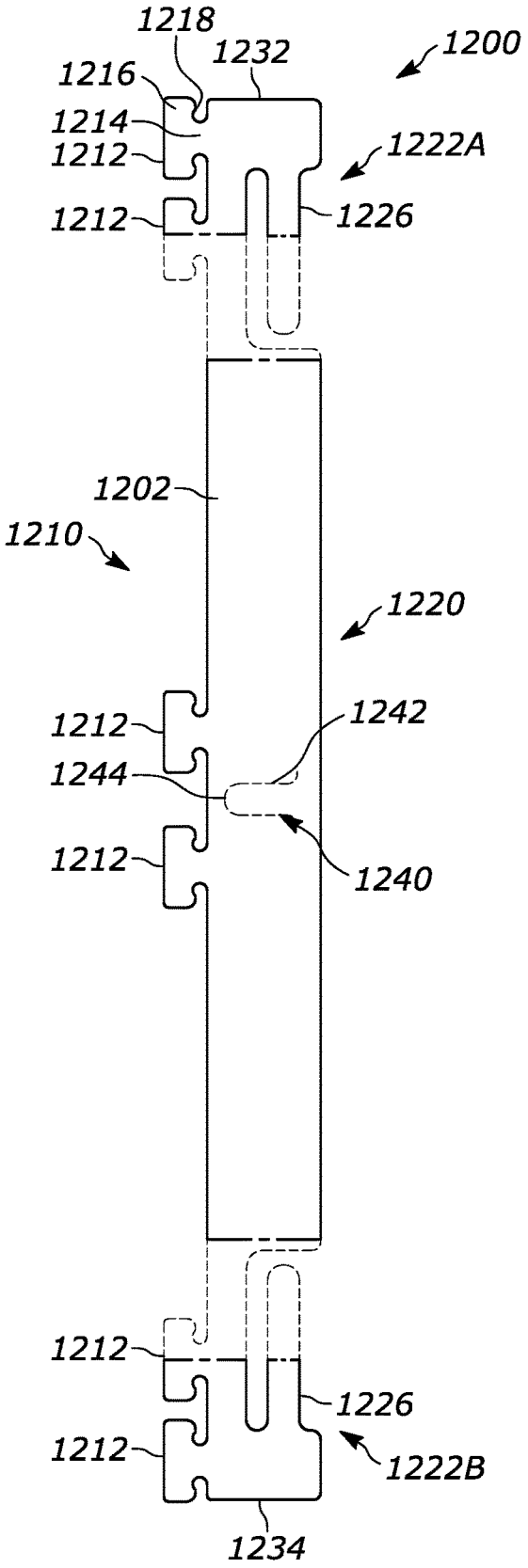
FIG. 12 is a top plan view of a coupling device according to a twelfth embodiment.

With reference to FIG. 12 a coupling device 1200 according to a twelfth embodiment is shown.

Figure 13:
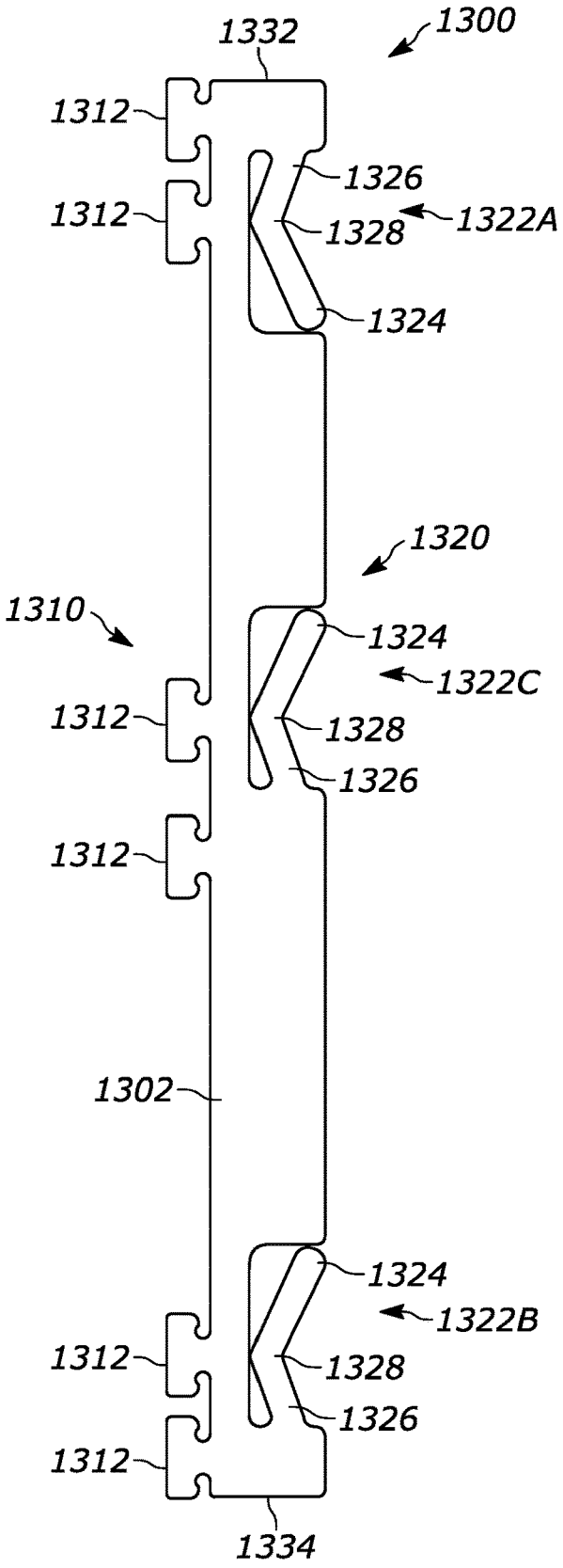
FIG. 13 is a top plan view of a coupling device according to a thirteenth embodiment.

With reference to FIG. 13, a coupling device 1300 is shown according to a thirteenth embodiment. The coupling device 1300 is similar in many respects to the coupling device 400 of FIG. 4, the primary difference being the orientation and length of the retention arms 1322. Specifically, the upper retention arm 1322A generally extends inward, toward the lower end 1334 of the coupling device 1300 and the lower and middle retention arms 1322B,C generally extends inward, toward the upper end 1332. While the upper retention arm 1322A still extends in generally the opposite direction of the lower retention arm 1322B, which as described above aids in retaining stationery coupled thereto, the upper and lower retention arms 1322A,B extend inward rather than outward. In the embodiment shown in FIG. 13 the retaining portions 1326 extend approximately 0.5 inches from their attachment point to the elongate body 1302 at approximately a 20° angle relative to the longitudinal axis of the coupling device 1300. The guide portions 1324 extend approximately 0.82 inches from the ends of the retaining portions 1326 at approximately a 44° angle from the retaining portion 1326 forming the elbow 1328.

Figure 14:
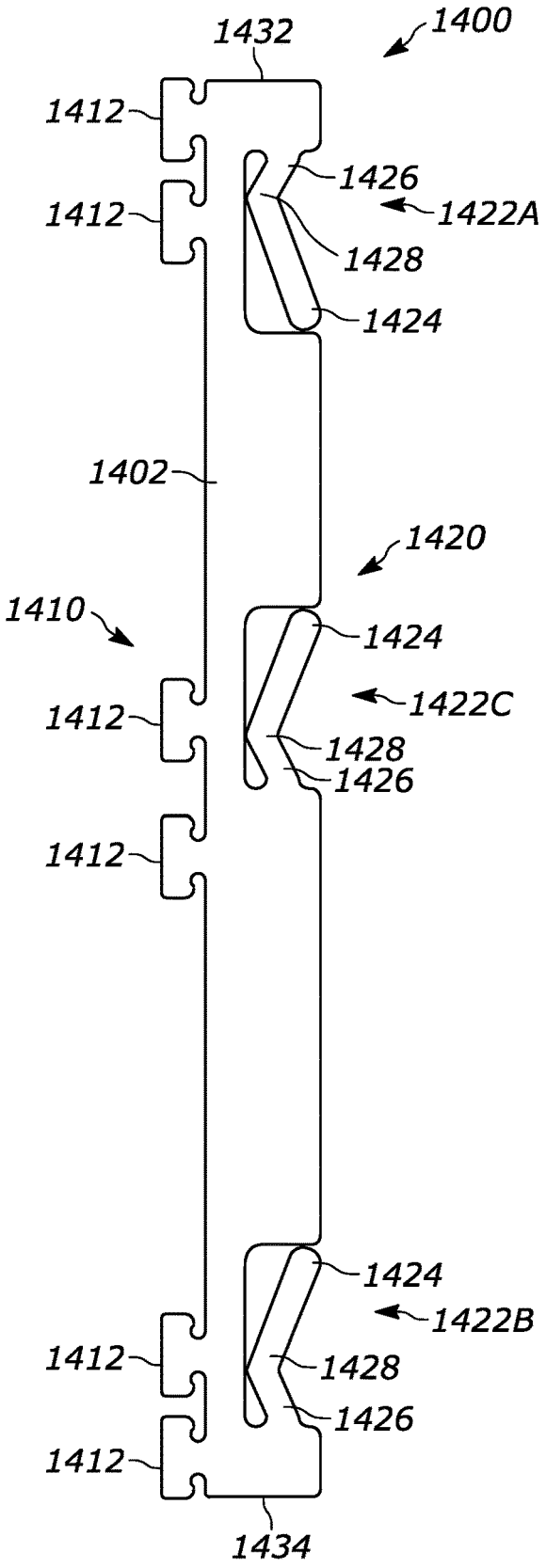
FIG. 14 is a top plan view of a coupling device according to a fourteenth embodiment.

With reference to FIG. 14, a coupling device 1400 is shown according to a fourteenth embodiment. The coupling device 1400 is similar in many respects to the coupling device 1300 of FIG. 13, with the primary difference being a change in length of the retaining portion 1426 and the guide portion 1424 of the retention arms 1422 and the angle formed by the retaining portion 1426 and the guide portion 1424. The retaining portions 1426 of the retention arms 1422A,B,C extend approximately 0.36 inches from the elongate body 1402 at an approximately 30° angle relative to the longitudinal axis of the coupling device 1400. The guide portions 1424 of the retention arms 1422A,B,C extend approximately 0.96 inches from the retaining portion 1426 at approximately a 50° angle relative to the retaining portion 1426 thus forming the elbows 1428.

Figure 15:
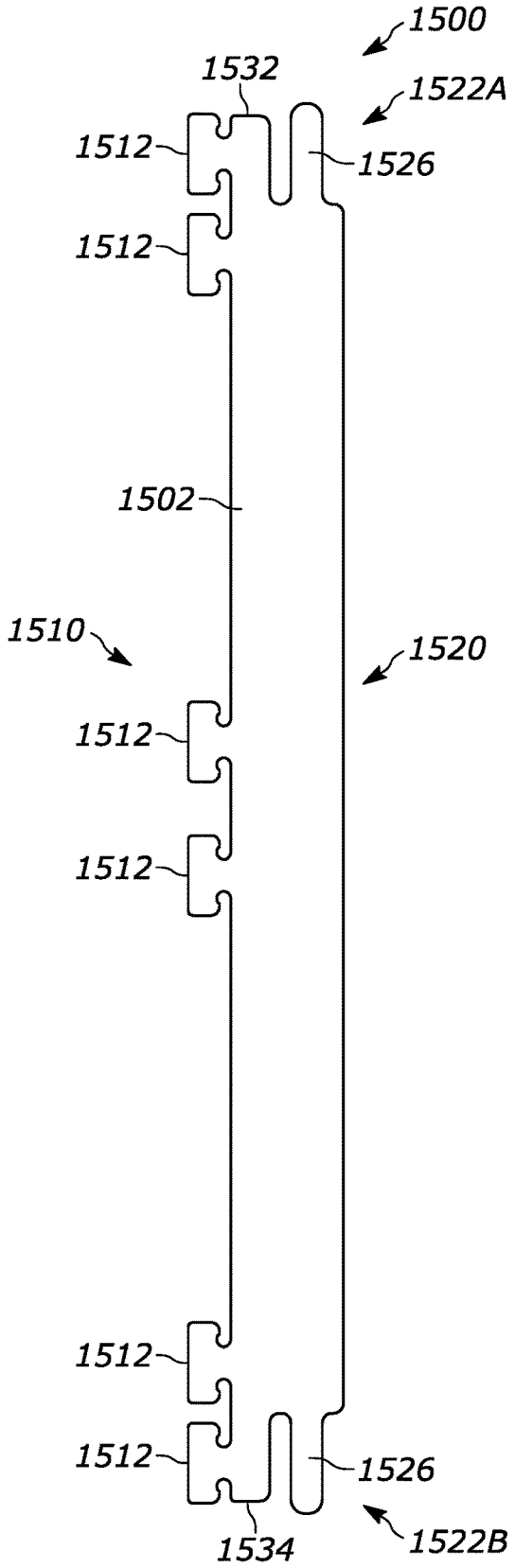
FIG. 15 is a top plan view of a coupling device according to a fifteenth embodiment.

With reference to FIG. 15, a coupling device 1500 is shown according to a fifteenth embodiment. The coupling device 1500 is similar in many respects to the coupling device 400 of FIG. 4, the primary difference being that the upper and lower retention arms 1522A,B do not include an elbow and the coupling device 1500 does not include a middle retention arm. The upper and lower retention arms 1522A,B only include a retaining portion 1526 that extends from the elongate body 1502 substantially parallel to the longitudinal axis of the coupling device 1500. As shown in FIG. 15, the retention arms 1522A,B extend approximately 0.7 inches from their attachment point to the elongate body 1502. Using retention arms 1522A,B that do not include an elbow or an angle therein makes attaching the stationery to the second coupling mechanism 1520 easier as the retention arms 1522A,B may more easily be passed through the holes of the stationery during attachment.

Figure 16:
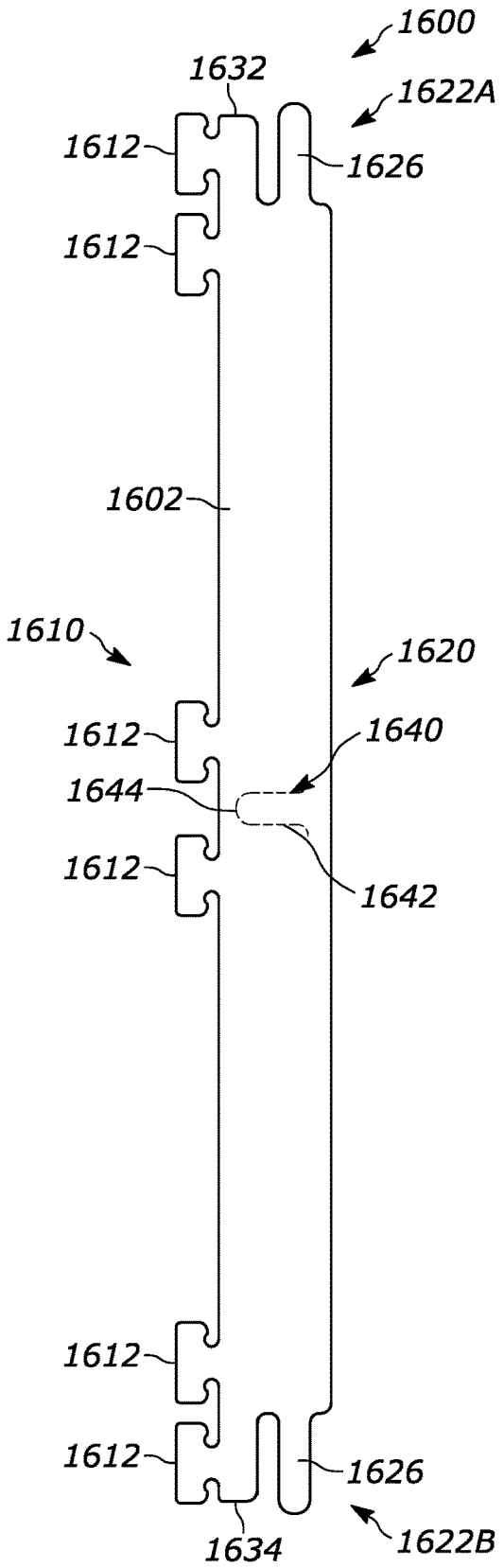
FIG. 16 is a top plan view of a coupling device according to a sixteenth embodiment.

With reference to FIG. 16, a coupling device 1600 is shown according to a sixteenth embodiment. The coupling device 1600 is similar in many respects the coupling device 1500 of FIG. 15, the primary difference being that the coupling device 1600 includes a tongue 1640 in between the upper and lower retention arms 1622A,B. As described in regard to the embodiments above, the tongue 1640 aids to attach and stabilize stationery attached to the second coupling mechanism 1620.

While the embodiments of the coupling device shown in the figures show the upper retention arm and the lower retention arm extending in generally opposite directions, those having skill in the art will appreciate that the upper retention arm and lower retention arm may be modified to extend in generally the same direction. In some forms, the coupling device may include a middle retention arm that extends in generally the opposite direction or in a direction perpendicular to the first retention arm and the second retention arm to aid in retaining the stationery on the second coupling mechanism. Moreover, it should be understood that one or more aspects of the various embodiments described herein may be modified or combined to form additional embodiments. For instance, the coupling device 500 of FIG. 5 may be modified to replace the upper retention arm 522A shown in FIG. 5 with the upper retention arm 1522A shown in FIG. 15. Similar modifications or combinations of the various embodiments described herein are contemplated.

Figure 17A:
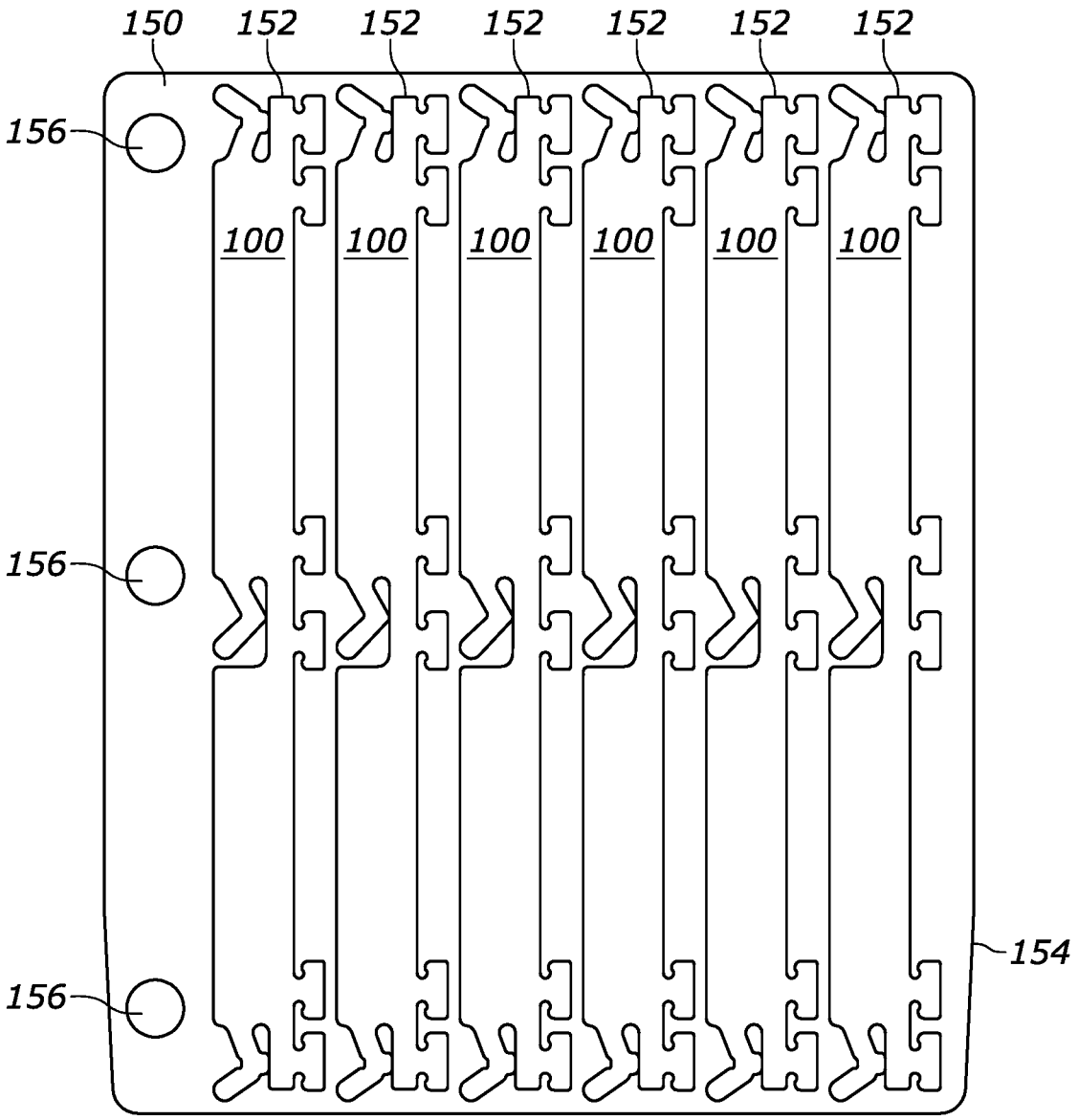
FIG. 17A is a top plan view of a sheet including a plurality of coupling devices of FIG. 1A.

With reference to FIG. 17A, a sheet 150 is shown according to a first embodiment that includes six coupling devices 100 formed therein by a plurality of die cuts 152. As used herein the die cuts may include partial depth die cuts and/or discontinuous die cuts, such that the individual coupling devices are easily removed from the sheet 150 by the application of manual pressure. The die cuts may be, for example, mechanically cut, laser cut, or formed in another, similar manner. Once the cuts are formed in the sheet 150, the coupling devices 100 may be removed from the sheet 150 by the application of manual force and used as described above. In other embodiments, other numbers of coupling devices 100 may be formed in the sheet 150. By one approach, the sheet 150 is formed of a semi-rigid plastic material such as polypropylene, polyethylene, cardboard, paperboard, or a combination thereof. Where the sheet 150 is formed of a paper-based product, the sheet 150 may include a waterproof coating and/or lamination thereon to increase the rigidity, durability, and reusability of the coupling devices 100. The coupling device 100 may remain attached to the sheet 150 until the coupling device 100 is needed or desired for use. For instance, the die cuts 152 used to form the coupling devices 100 in the sheet 150 may include a plurality of ties or uncut portions extending between the coupling devices 100 and the sheet 150 that need to be broken to remove a coupling device 100 from the sheet 150. The sheet 150 may include hole punches 156 for attaching the sheet 150 to a three-ring binder, or the second coupling mechanism of a coupling device as described herein, for storage. The sheet 150 may also be stored in a pocket, for example, the pocket of a notebook, folder, or binder, or included within an overwrap around a notebook. In addition, the lower end 154 of the sheet 150 may narrow or taper to aid in inserting the sheet 150 into the pocket.

While the sheet 150 shown in FIG. 17A shows a plurality of coupling devices 100 of the first embodiment cut therein, in other embodiments, the sheet 150 may include a plurality of die cuts therein that form the coupling devices of one or more of the other embodiments disclosed herein.

Figure 17B:
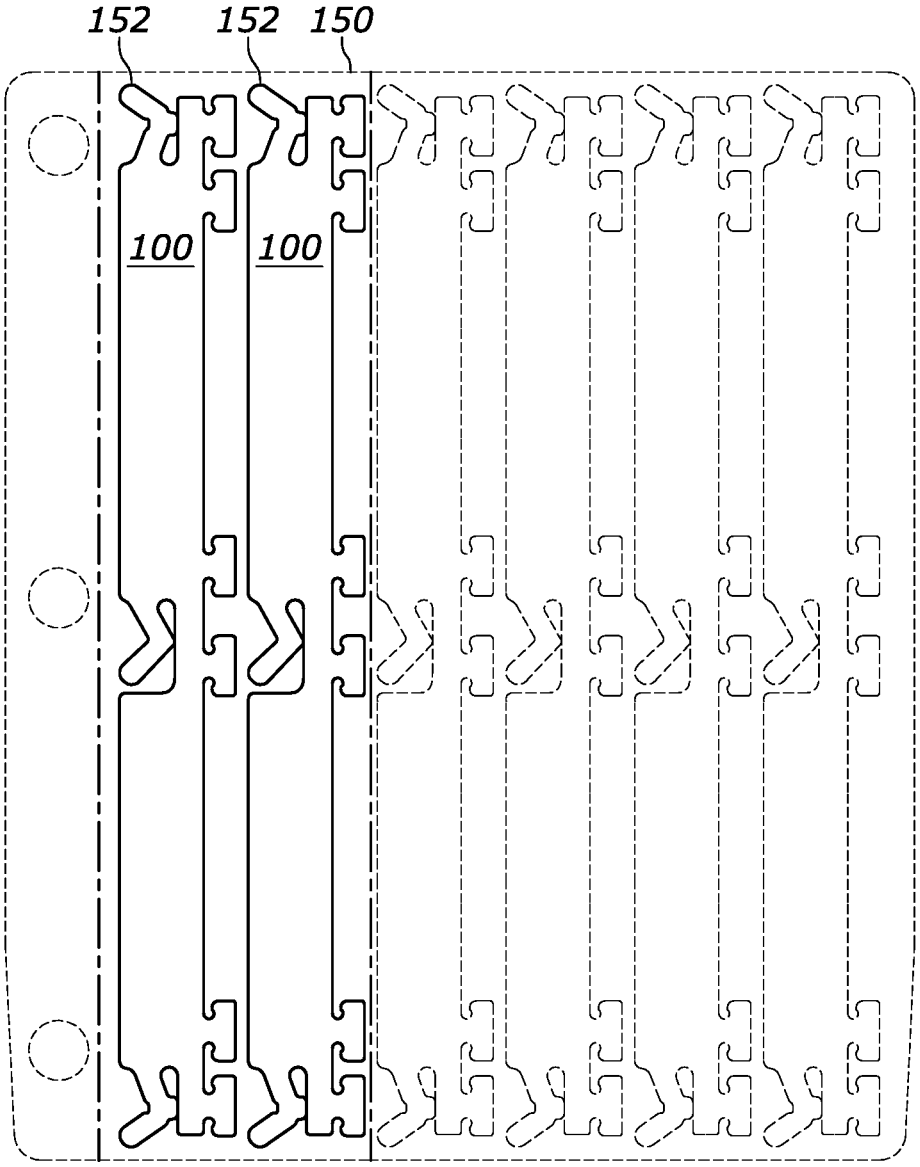
FIG. 17B is a top plan view of a second embodiment of a sheet including at least two coupling devices of FIG. 1A.

With reference to FIG. 17B, a top plan view of a second embodiment of a sheet 150 is shown including at least two coupling devices of FIG. 1A.

Uses of singular terms such as "a," "an," are intended to cover both the singular and the plural, unless otherwise indicated herein or clearly contradicted by context. The terms "comprising," "having," "including," and "containing" are to be construed as open-ended terms. It is intended that the phrase "at least one of" as used herein be interpreted in the disjunctive sense. For example, the phrase "at least one of A and B" is intended to encompass only A, only B, or both A and B.

While there have been illustrated and described particular embodiments of the present invention, those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A coupling device comprising:

an elongate body having a first coupling mechanism along a first side and a second coupling mechanism along a second side;

the first coupling mechanism including a plurality of projections configured to attach to a binding including an array of coils; and the second coupling mechanism including a first retention arm and a second retention arm attached at the second side of the body for inserting through holes formed in stationery to attach the stationery to the elongate body, the first retention arm extending at least in part toward a first end of the elongate body and the second retention arm extending at least in part toward a second end of the elongate body, wherein the first retention arm and the second retention arm are elastically deflectable from respective original positions, wherein the first retention arm and the second retention arm elastically return toward the respective original positions to secure the stationery to the elongate body.

2. The coupling device of claim 1 wherein the elongate body is formed of a unitary piece of semi-rigid elastic material such that when the elongate body or a portion thereof is flexed from an original position to attach the stationery to the elongate body the elongate body or the portion thereof elastically returns to the original position when no force is applied to the elongate body or portion thereof.

3. The coupling device of claim 1 wherein at least a portion of the first retention arms and second retention arms are disposed:

parallel to a lengthwise direction of the elongate body; or at an angle of between +/−45 degrees from the lengthwise direction of the elongate body.

4. The coupling device of claim 3 wherein the retaining portion and the guide portion of the first retention arm are connected at an angle such that the first retention arm is substantially V-shaped.

5. The coupling device of claim 1 wherein the elongate body further comprises a third retention arm attached at the second side of the elongate body at a position between the first and second retention arms.

6. The coupling device of claim 5 wherein the third retention arm extends at least in part in a first longitudinal direction.

7. The coupling device of claim 5 wherein the third retention arm is a tongue that extends toward the first side of the elongate body.

8. The coupling device of claim 1 wherein the first coupling mechanism includes a plurality of projections extending from the first side of the body, each of the plurality of projections having a neck portion extending away from the first side of the body with a head portion disposed on an end of the neck portion, the head portion having a longitudinal length that is greater than a longitudinal length of at least a portion of the neck portion.

9. The coupling device of claim 1 wherein the first retention arm and the second retention arm are unitarily formed.

10. A coupling device comprising:

an elongate body having a first coupling mechanism along a first side and a second coupling mechanism along a second side;

the first coupling mechanism including a plurality of projections configured to attach to a binding including an array of coils; and the second coupling mechanism including a first retention arm and a second retention arm attached at the second side of the body for inserting through holes formed in stationery to attach the stationery to the elongate body, the first retention arm extending at least in part toward a first end of the elongate body and the second retention arm extending at least in part toward a second end of the elongate body, wherein at least one of the first or second retention arms includes a retaining portion and a guide portion, the retaining portion attached to the elongate body and extending at least in part toward the first side of the elongate body and the guide portion attached to the retaining portion and extending away from the retaining portion.

11. The coupling device of claim 10 wherein the first retention arm includes an elbow disposed between the retaining portion and guide portion, the elbow adjacent a remainder of the elongate body such that the retaining portion and guide portion of the first retention arm are angled away from the remainder.

12. The coupling device of claim 11 wherein the elbow includes a protrusion extending toward the remainder of the elongate body, the remainder of the elongate body including a notch that receives the protrusion of the elbow.

13. The coupling device of claim 11 wherein the guide portion includes a tip for inserting into a hole of stationery, the guide portion and the elbow sized to pass through the hole such that a portion of the stationery forming the hole encircles the retaining portion of the first retention arm.

14. The coupling device of claim 4 wherein the retaining portion of the first retention arm extends proximal an edge of the elongate body such that the first retention arm prevents the portion of the stationery from passing between the retaining portion and the edge of the elongate body when the first retention arm is not flexed away from the edge of the elongate body.

15. A coupling device comprising:

an elongate body having a first coupling mechanism along a first side and a second coupling mechanism along a second side;

the first coupling mechanism including a plurality of projections configured to attach to a binding including an array of coils; and the second coupling mechanism including a first retention arm and a second retention arm attached at the second side of the body for inserting through holes formed in stationery to attach the stationery to the elongate body, the first retention arm extending at least in part toward a first end of the elongate body and the second retention arm extending at least in part toward a second end of the elongate body, wherein the first retention arm is for insertion into a first hole of stationery and the second retention arm is for insertion into a second hole of the stationery such that substantial lateral movement of the stationery relative to the elongate body is restricted unless the first and second retention arms are flexed.

16. A coupling device comprising: an elongate body having a first coupling mechanism along a first side and a second coupling mechanism along a second side;

the first coupling mechanism including a plurality of projections configured to attach to a binding including an array of coils; and the second coupling mechanism including a first retention arm and a second retention arm attached at the second side of the body for inserting through holes formed in stationery to attach the stationery to the elongate body, the first retention arm extending at least in part toward a first end of the elongate body and the second retention arm extending at least in part toward a second end of the elongate body, wherein the first retention arm and the second retention arm are elastically deflectable from respective original positions, wherein the first retention arm is spaced apart from the second retention arm such that when the first retention arm is inserted into a first hole of stationery and the second retention arm is inserted into a second hole of the stationery, the stationery is not able to be detached from the elongate body without flexing at least one of the first and second retention arms.

17. An apparatus comprising:

a semi-rigid sheet of flexible material including a plurality of die-cuts therein, the plurality of die-cuts forming a plurality of partially die-cut handout coupling mechanisms, wherein each of the plurality of partially die-cut handout coupling mechanisms include an elongate body having a first coupling mechanism along a first side and a second coupling mechanism along a second side, the first coupling mechanism configured to attach to a binding including an array of coils, the second coupling mechanism including a first retention arm and a second retention arm attached at the second side of the elongate body for inserting through holes formed in stationery to attach the stationery to the elongate body, the first arm extending at least in part in a first longitudinal direction, the second arm extending at least in part in a second longitudinal direction opposite the first longitudinal direction.

18. The apparatus of claim 17, wherein a handout coupling mechanism of the plurality of handout coupling mechanisms is removeable from the semi-rigid sheet by breaking one or more attachment ties extending between the semi-rigid flexible sheet and the handout coupling mechanism, the attachment ties formed between adjacent die-cuts forming the handout coupling mechanism.

19. The coupling device of claim 18 wherein the plurality of handout coupling mechanisms are formed of a semi-rigid elastic material such that when a handout coupling mechanism of the plurality is flexed from an original position the handout coupling mechanism returns to the original position when no force is applied thereto.

20. The coupling device of claim 19 wherein the semi-rigid elastic material comprises at least one of polypropylene, polyethylene, cardboard, paperboard, or a combination thereof.

21. The coupling device of claim 19 wherein the semi-rigid sheet is coated with a waterproof material to increase durability and reusability.

22. The coupling device of claim 17 wherein the first coupling mechanism comprises a plurality of t-shaped extensions configured to snap into a space between adjacent coils of the array of coils.

23. A handout coupling kit comprising:

a notebook having a coil binding and a plurality of sheets coupled to the coil binding; and a semi-rigid sheet of flexible material including a plurality of die-cuts therein, the plurality of die-cuts forming a plurality of partially die-cut handout coupling mechanisms, wherein each of the plurality of partially die-cut handout coupling mechanisms include an elongate body having a first coupling mechanism along a first side and a second coupling mechanism along a second side, the first coupling mechanism configured to attach to the coil binding of the notebook, the second coupling mechanism including a first retention arm and a second retention arm attached at the second side of the elongate body for inserting through holes formed in stationery to attach the stationery to the elongate body, the first arm extending at least in part in a first longitudinal direction, the second arm extending at least in part in a second longitudinal direction opposite the first longitudinal direction.

24. The handout coupling kit of claim 23 wherein the semi-rigid sheet is secured to the notebook via an overwrap enveloping the notebook and the semi-rigid sheet.

25. The handout coupling kit of claim 23 wherein the notebook includes a pocket coupled to the coil binding, wherein the semi-rigid sheet is positioned within the pocket.

26. The handout coupling kit of claim 23 wherein the semi-rigid sheet is coupled to the coil binding of the notebook.

* * * * *